US011479035B2

(12) United States Patent
Hudd et al.

(10) Patent No.: US 11,479,035 B2
(45) Date of Patent: Oct. 25, 2022

(54) INDUSTRIAL PRINTHEAD

(71) Applicant: Jetronica Limited, Lancashire (GB)

(72) Inventors: Alan Hudd, Lancashire (GB); Albert Kocsis, Budapest (HU)

(73) Assignee: JETRONICA LIMITED, Blackburn (GB)

( * ) Notice: Subject to any disclaimer, the term of this patent is extended or adjusted under 35 U.S.C. 154(b) by 618 days.

(21) Appl. No.: 16/328,419

(22) PCT Filed: Aug. 29, 2017

(86) PCT No.: PCT/GB2017/052516
§ 371 (c)(1),
(2) Date: Feb. 26, 2019

(87) PCT Pub. No.: WO2018/042165
PCT Pub. Date: Mar. 8, 2018

(65) Prior Publication Data

US 2021/0300017 A1 Sep. 30, 2021

(30) Foreign Application Priority Data

Aug. 30, 2016 (GB) ..... 1614637

(51) Int. Cl.
*B41J 2/025* (2006.01)
*B41J 2/04* (2006.01)
(Continued)

(52) U.S. Cl.
CPC ..... *B41J 2/025* (2013.01); *B41J 2/04* (2013.01); *B41J 2/04575* (2013.01); *B41J 2002/16567* (2013.01)

(58) Field of Classification Search
CPC . B41J 2/025; B41J 2/04; B41J 2/04575; B41J 2002/16567
See application file for complete search history.

(56) References Cited

U.S. PATENT DOCUMENTS 3,368,085 A * 2/1968 Dettloff ..... B06B 3/00 59/51
4,005,435 A * 1/1977 Lundquist ..... B41J 2/025 366/127
(Continued)

FOREIGN PATENT DOCUMENTS

GB 2001010 A 1/1979
GB 2037234 A 7/1980
(Continued)

OTHER PUBLICATIONS

International Search Report and Written Opinion received in corresponding PCT Application PCT/GB2017/052516 completed Nov. 16, 2017.
(Continued)

*Primary Examiner* — Henok D Legesse
(74) *Attorney, Agent, or Firm* — Vorys, Sater, Seymour and Pease LLP

(57) ABSTRACT

An industrial printhead (100) comprising a flow channel enclosed in a chamber, wherein the flow channel (102) has at least one fluid inlet (102*a*) and at least one fluid outlet (102*b*), wherein the flow channel is resonated, in use, by a vibration distributor (104) comprising a mass resonator (103), piezoelectric exciter (108) and wave concentrator (110) arranged in an axial configuration.

14 Claims, 2 Drawing Sheets

(51) Int. Cl.
*B41J 2/045* (2006.01)
*B41J 2/165* (2006.01)

(56) References Cited

U.S. PATENT DOCUMENTS 5,154,347 A * 10/1992 Vijay ..... B24C 1/00 239/4
6,224,180 B1 * 5/2001 Pham-Van-Diep ..... B05B 17/06 347/81
6,425,660 B1 * 7/2002 Sherman ..... B41J 2/025 347/75
6,460,980 B1 * 10/2002 Hegedus ..... B41J 2/025 347/68
8,439,487 B2 * 5/2013 Clarke ..... B01J 13/02 347/73
2001/0015735 A1 * 8/2001 Matsumoto ..... B41J 2/04588 347/7
2004/0046839 A1 * 3/2004 Pannu ..... B41J 2/025 347/73
2006/0191562 A1 * 8/2006 Nunomura ..... B08B 3/02 134/198

FOREIGN PATENT DOCUMENTS

| | | | |
|---|---|---|---|
| GB | 1592819 | A | 7/1981 |
| JP | S56137973 | A | 10/1981 |
| JP | S6285948 | A | 4/1987 |
| WO | 199851503 | A1 | 11/1998 |
| WO | 1999046126 | A | 9/1999 |
| WO | 200234526 | A1 | 5/2002 |
| WO | 2010003933 | A2 | 1/2010 |

OTHER PUBLICATIONS

Search Report received in corresponding GB Application No. GB1614637.5 dated Mar. 1, 2017.

* cited by examiner

PRIOR ART

INDUSTRIAL PRINTHEAD

FIELD

The present invention relates to an industrial printhead.

BACKGROUND

Piezoactuated needles are known to be useful for the deposition of fluids based on the mechanism described in PCT/HU1999/000015. However, the industrial application of the technology requires that a number of operational characteristics of the system are improved to ensure consistent operation and achieve the printing of fluids with high viscosity and/or high solids loading of small or large pigment particles, required for many applications.

The printhead design described in PCT/HU1999/000015 had several limitations due to its small construction. The limitations include operating power, and due to the small dissipating surface and small piezo element, which may be 'depolarized' or stop mechanically functioning if overloaded.

In this patent we describe a printhead design that overcomes the industrial limitations of the invention previously described including the following main larger transducer parts and increased vibrating mass, higher input power and the dimensions and quantities of each component material have been modified to increase flow rate down the printing nozzle (including mass resonator, piezo exciter and wave concentrator as shown in FIG. 2).

We describe the invention of an industrial printhead configuration that overcomes the limitations of the configuration described in PCT/HU1999/000015 to generate a novel and industrially applicable embodiment of piezo actuated flow channel deposition principle, with increased capability fluids with high viscosity and/or high solids loading of small or large pigment particles

SUMMARY

An aspect of the invention provides an industrial printhead comprising a flow channel enclosed in a chamber, wherein the flow channel has at least one fluid inlet and at least one fluid outlet, wherein the flow channel is resonated, in use, by a vibration distributor comprising a mass resonator, piezoelectric exciter and wave concentrator arranged in an axial configuration.

Advantageously, industrial printheads according to the above aspect of the invention can distribute viscous fluids having a viscosity between 100-1000 cP and/or a particle size between 20-500 micron plus with different anisotropy.

In one embodiment, the mass resonator has a greater mass density than the wave concentrator.

Advantageously, such a construction provides a higher vibrating amplitude through the wave concentrator.

In one embodiment, the wave concentrator is conical in shape.

A conical shaped wave concentrator provides a focused resonance to the flow channel.

In one embodiment, the at least one fluid outlet comprises two or more fluid outlets. In another embodiment each of the two or more fluid outlets has a flow direction perpendicular to the flow direction of the fluid channel.

Configuration of piezoactuated flow channel depositors to form an array that can be used industrially as a reliable digital printhead facilitates printing of fluids with high viscosity and/or high solids loading of small or large pigment particles An aspect of the invention provides an industrial printhead comprising of a single piezoactuated flow channel dispenser enclosed in a chamber. Due to the printhead's larger three dimensional shape, individual nozzle cannot be stacked at a low pitch, and therefore a multi-nozzle construction has also been developed, comprising of a single vibrating system to drive multiple jetting nozzles.

FIGURES

DESCRIPTION

Figure 1:
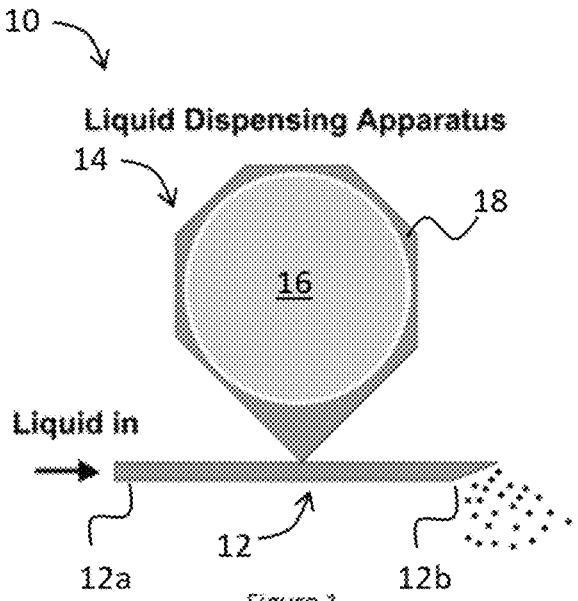
Figure 1 PRIOR ART
FIG. 1 shows a side view of a prior art industrial printhead.
Figure 2:
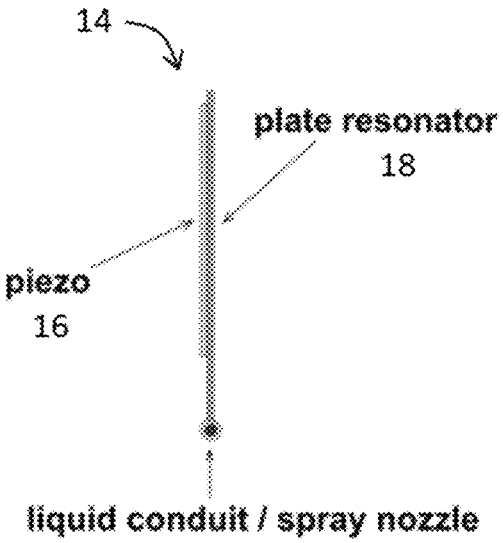
FIG. 2 shows an aerial view of the industrial printhead of FIG. 1.

A prior art industrial printhead design developed by the applicant is demonstrated in FIGS. 1 and 2. The prior art industrial printhead (10) shown in FIGS. 1 and 2 comprises a flow channel (12) having a fluid inlet (12*a*) and a fluid outlet (12*b*). A vibration distributor (14) is positioned in contact with the flow channel (12). The vibration distributor comprises a piezoelectric exciter (16) mounted to a plate resonator (18). Upon activation of the piezoelectric exciter (16), the plate resonator vibrates to enable viscous fluid to pass through the flow channel (12) from the fluid inlet (12*a*) to the fluid outlet (12*b*). The prior art industrial printhead (10) shown in FIGS. 1 and 2 is constructed in a two dimensional shape to enable individual nozzles to be placed at a close pitch of 2.54 mm to achieve sufficient printing resolution by individually addressing each needle on or off.

Figure 3:
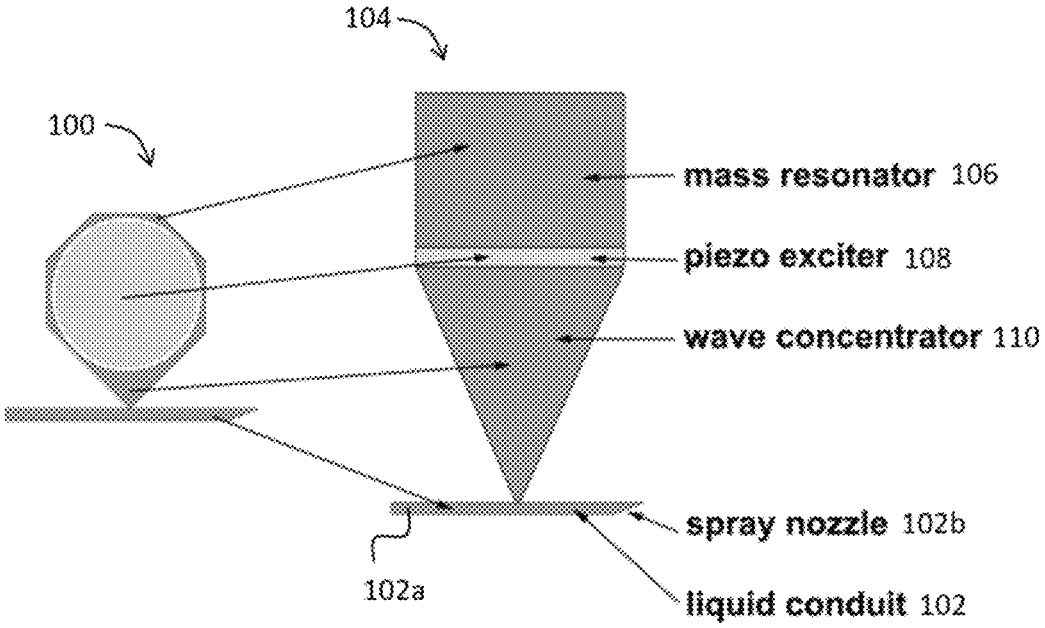
FIG. 3 shows one embodiment of industrial printhead according to aspects of the invention as compared to the prior art industrial printhead of FIG. 1.

A first embodiment of industrial printhead (100) according to the present invention is shown in FIG. 3. The industrial printhead (100) comprises a flow channel (102) having a fluid inlet (102*a*) and a fluid outlet (102*b*). A vibration distributor (104) is positioned in contact with the flow channel (102). The vibration distributor (104) comprises a mass resonator (106), a piezoelectric exciter (108) and a wave concentrator (110) arranged in axial alignment such that the piezoelectric exciter (108) is positioned between the mass resonator (106) and the wave concentrator (110). The mass resonator (106), piezoelectric exciter (108) and wave concentrator are clamped together in axial alignment using an axial fastener (not shown) such as a screw.

The vibration distributor (104) is generally cylindrical in shape with the wave concentrator (110) forming a cone such that the diameter of the wave concentrator (110), and consequently its mass, decreases along its length away from the piezoelectric exciter (108). The mass resonator (106) is made from a high density material such as steel or brass, for example. The wave concentrator (110) is also made from a high density material but the material of the wave concentrator (110) has a lower mass density than that of the mass resonator (106). The wave concentrator (110) may be made from titanium or aluminium, for example.

Figure 4:
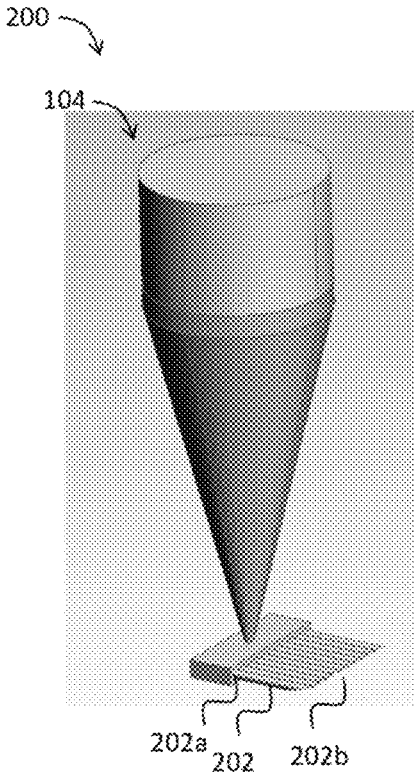
FIG. 4 shows a three-dimensional view of a multiple orifice nozzle plate design.

FIG. 4 shows a second embodiment of the invention. The industrial printhead (200) shown in FIG. 4 comprises a flow channel (202) having a fluid inlet (202*a*) and multiple fluid outlets (202*b*). The vibration distributor (104) shown in FIG. 3 is positioned in contact with the flow channel (202) such that the vibration distributor (104) can drive fluid through each of the multiple fluid outlets (202*b*). The embodiment envisaged in FIG. 4 requires each of the multiple fluid outlets (202*b*) to be supplied with fluid from a common fluid source. The common fluid source may comprise temperature regulating means (not shown) to regulate the temperature of the fluid contained therein.

Although FIG. 4 is described with reference to each of the multiple fluid outlets (202*b*) being supplied with fluid from a common fluid source, it will be appreciated that each of the multiple fluid outlets (202*b*) may also be supplied with fluid from respective individual fluid sources. In such an embodiment, further fluidic control elements will be required.

The invention claimed is:

1. An industrial printhead comprising a flow channel enclosed in a chamber, wherein the flow channel has at least one fluid inlet and two or more fluid outlets, wherein the flow channel is in contact with and is resonated, in use, by a single vibration distributor comprising a mass resonator, piezoelectric exciter and wave concentrator arranged in an axial configuration that is perpendicular to both the two or more fluid outlets and perpendicular to the flow channel, and wherein each of the two or more fluid outlets has a flow direction perpendicular to a flow direction of the flow channel.

2. The industrial printhead according to claim 1, wherein the mass resonator has a greater mass density than the wave concentrator.

3. The industrial printhead according to claim 1, wherein the single vibration distributor has a generally cylindrical cross-section.

4. The industrial printhead according to claim 1, where in the mass resonator is formed from a high density material such as steel or brass.

5. The industrial printhead according to claim 4, wherein the wave concentrator is formed from a high density material having a lower density than steel or brass, such high density material including aluminium or titanium.

6. The industrial printhead according to claim 1, wherein the single vibration distributor is joined to the flow channel.

7. The industrial printhead according to claim 1, wherein the mass resonator, piezoelectric exciter and wave concentrator are clamped together axially using an axial fastener.

8. The industrial printhead according to claim 1, wherein the flow channel is configured to receive fluid having a viscosity between 20-1000 cP.

9. The industrial printhead according to claim 1, wherein the flow channel is configured to receive fluid having a range of pigment sizes from 1 micron to 500 micron and/or fluids have particles of different anisotropy.

10. The industrial printhead according to claim 1, wherein each of the two or more fluid outlets are spaced apart from adjacent fluid outlets by 2.54 mm.

11. The industrial printhead according to claim 1, wherein each of the two or more fluid outlets are supplied with fluid from a common fluid source.

12. The industrial printhead according to claim 11, wherein the, or each, fluid source is provided with heating means to heat the fluid contained therein.

13. The industrial printhead according to claim 1, wherein each of the two or more fluid outlets are supplied with fluid from individual fluid sources.

14. An industrial printhead comprising a flow channel enclosed in a chamber, wherein the flow channel has two or more fluid inlets and two or more fluid outlets, wherein the flow channel is in contact with and is resonated, in use, by a single vibration distributor comprising a mass resonator, piezoelectric exciter and wave concentrator arranged in an axial configuration that is perpendicular to both the two or more fluid outlets and perpendicular to the flow channel, wherein the wave concentrator has a lower mass density than the mass resonator, and wherein each of the two or more fluid outlets has a flow direction perpendicular to a flow direction of the flow channel.

* * * * *